US007016633B2

(12) United States Patent
Ishigaki

(10) Patent No.: US 7,016,633 B2
(45) Date of Patent: Mar. 21, 2006

(54) DEVELOPING ASSEMBLY FEATURING A DEVELOPER-CARRYING MEMBER HAVING SPECIFIED RANGES OF DEFORMATION AND HARDNESS AND A DEVELOPER QUALITY CONTROL BLADE HAVING A ROUGH CONTACT SURFACE

(75) Inventor: Toru Ishigaki, Chiba (JP)

(73) Assignee: Canon Kasei Kabushiki Kaisha, Tsukuba (JP)

( * ) Notice: Subject to any disclaimer, the term of this patent is extended or adjusted under 35 U.S.C. 154(b) by 0 days.

(21) Appl. No.: 11/031,068

(22) Filed: Jan. 10, 2005

(65) Prior Publication Data

US 2005/0111885 A1 May 26, 2005

Related U.S. Application Data

(62) Division of application No. 10/408,577, filed on Apr. 8, 2003, now abandoned.

(30) Foreign Application Priority Data

Apr. 12, 2002 (JP) ..... 2002-110545

(51) Int. Cl.
*G03G 15/08* (2006.01)

(52) U.S. Cl. ..... 399/279; 399/284

(58) Field of Classification Search ..... 399/279, 399/284, 274, 286

See application file for complete search history.

(56) References Cited

U.S. PATENT DOCUMENTS

| | | | | |
|---|---|---|---|---|
| 3,892,078 | A | 7/1975 | Closson, Jr. | 36/68 |
| 5,689,783 | A | 11/1997 | Sasame et al. | 399/284 |
| 5,776,395 | A | 7/1998 | Fujiwara et al. | 264/146 |
| 5,812,918 | A * | 9/1998 | Nakaue et al. | 399/284 |
| 5,895,150 | A | 4/1999 | Watabe et al. | 399/284 |
| 6,128,458 | A * | 10/2000 | Sato | 399/252 |
| 2003/0070748 | A1 | 4/2003 | Ishigaki et al. | 156/244.18 |

FOREIGN PATENT DOCUMENTS

| | | |
|---|---|---|
| JP | 9-50185 | 2/1997 |
| JP | 2001-255738 | 9/2001 |

* cited by examiner

*Primary Examiner*—Quana Grainger
(74) *Attorney, Agent, or Firm*—Fitzpatrick, Cella, Harper & Scinto

(57) ABSTRACT

In a developing assembly comprising a developer-carrying member and a developer quantity control blade kept in pressure contact with the developer-carrying member, the developer-carrying member has a deformation percentage D of 0.5% or less in the direction of pressure contact, and the developer quantity control blade has a ten-point average roughness Rz of from 0.3 $\mu$m to 20 $\mu$m at its surface on the side kept in contact with the developer-carrying member (a charge control face). The developing assembly can prevent faulty images such as lines and uneven images due to the deformation of developer-carrying member even though any deformation due to the pressure contact of the developer quantity control blade has taken place in the developer-carrying member while the developing assembly is stopped.

6 Claims, 4 Drawing Sheets

DEVELOPING ASSEMBLY FEATURING A DEVELOPER-CARRYING MEMBER HAVING SPECIFIED RANGES OF DEFORMATION AND HARDNESS AND A DEVELOPER QUALITY CONTROL BLADE HAVING A ROUGH CONTACT SURFACE

CROSS-REFERENCE TO RELATED APPLICATION

This application is a divisional application of application Ser. No. 10/408,577, filed Apr. 8, 2003 now abandoned.

BACKGROUND OF THE INVENTION

1. Field of the Invention

This invention relates to a blade which controls the quantity of a developer used to develop and render visible an electrostatic latent image formed on an image-bearing member (i.e., a developer quantity control blade), and a developing assembly to which this blade is attached. This invention also relates to a process for manufacturing the developer quantity control blade.

2. Related Background Art

FIG. 5 schematically illustrates the construction of a developing assembly. A one-component developer (also called a toner) 46 for example, held in a developer container 42, is pressed against, and to stick to, a developer-carrying member (also called a developing sleeve or developing roller) 43 by means of an elastic roller 45 which rotates in the direction of an arrow c. Thereafter, as the developer-carrying member 43 is rotated in the direction of an arrow b, the developer is carried from the developer container to an electrophotographic photosensitive member 41 which rotates in the direction of an arrow a. In such a mechanism, a blade member 47 of a developer quantity control blade 44 is kept in control with the developer-carrying member 43, and the quantity of the developer carried from the developer container to the developer-carrying member is controlled (regulated), where a thin layer of the developer is formed and at the same time the developer is provided with stated triboelectric charges (also called triboelectricity) at a contact zone.

The developer quantity control blade is commonly formed of a rubber plate, a metallic sheet, a resin plate or a laminate of any of these. The developer quantity control blade is made up from a blade member which is brought into pressure contact with the developer-carrying member and a support member which supports the blade member at a preset position. The face of the blade member that is brought into pressure contact with the developer-carrying member has a function of controlling the triboelectric charges of the developer. Accordingly, this face is also called a charge control face. The surface layer of this charge control face is also called a charge control layer in some cases.

As blade members used for negative-type toners, plate members of urethane rubbers, urethane resins or polyamide elastomers are used, for example. Also, as developer quantity control blades used for positive-type toners, those obtained by laminating a charge-providing layer of charge-controlled silicone rubber or the like to a metallic sheet are used.

With regard to a non-magnetic toner used in the formation of color images, its thin layer must be formed on a developing sleeve or a developing roller, providing the toner with high triboelectric charges, because the toner itself does not have any magnetic properties. In this case, as materials used in the charge control layer, they may include urethane rubbers, polyamide resins, polyamide elastomers, silicone rubbers and silicone resins. The charge control face is finished so as to have good face precision.

In recent years, fine-particle toners are used in developing assemblies having been made high-quality and full-color in which an electrophotographic process is applied, and hence the toners are required to be more uniformly pressed against, and made to stick to, the developing sleeve or developing roller. Especially because of any influence by the surface roughness of the charge control face, faulty images such as uneven images and undesirable lines may occur.

In recent years, fine-particle toners are used in developing assemblies having been made high-quality and full-color in which an electrophotographic process is applied, and hence the toners are required to be more uniformly pressed against, and made stick to, the developing sleeve or developing roller. Especially because of any influence by the surface roughness of the charge control face, faulty images such as uneven images and undesirable lines may occur.

Japanese Patent Application Laid-open No. 09-050185 discloses a proposal of a blade member made of a polyamide elastomer or a polyamide resin, used for negative-type toners. As a manufacturing method, a method making use of a metal mold having a mirror face is disclosed. Also, in blade members made of urethane rubbers, an example is reported in which the charge control face is similarly formed by mold face transfer. However, where the method disclosed in this publication is employed, the surface properties of the charge control face is influenced by how the mold mirror face is maintained and controlled, and there is a possibility of resulting in non-uniform product quality depending on how it has been controlled.

In respect of positive-type toners also, how the mold mirror face is maintained and controlled is also an important quality control item in developer quantity control blade members made of thermosetting silicone rubbers or urethane rubbers.

However, although the developer has been transported under control using such a developer quantity control blade manufactured under severe product quality control in the manner as stated above, a difficulty as stated below has arisen in some cases.

That is, where the developer quantity control blade is kept in pressure contact with the developer-carrying member at a pressure-contact pressure necessary for charging the developer sufficiently and for forming a uniform thin layer, this has caused an imperceptible deformation in the developer-carrying member in some cases. Especially when the developing assembly is stopped from being driven and is left as it is, the developer-carrying member undergoes deformation. Even though the deformation is imperceptible, it has come about in some cases that the developer-carrying member does not recover from its deformation after it is resumed being driven. Then, this deformation has caused faulty images such as lines and uneven images in some cases.

On the other hand, if the developer-carrying member is made to have a high surface hardness in order to keep the developer-carrying member from its deformation, it has come about in some cases that the developer quantity control blade wears soon, that the blade can not provide the developer with the stated triboelectricity or that the developer-carrying member can not transport the developer in the stated quantity.

Thus, it has been unable to well keep the developer-carrying member from undergoing such imperceptible deformation, and the developer-carrying member's deformation taken place while the developing assembly is stopped has caused faulty images such as lines and uneven images in some cases.

SUMMARY OF THE INVENTION

Taking account of such circumstances, an object of the present invention is to provide a developing assembly which can prevent faulty images such as undesirable lines and uneven images due to the deformation of developer-carrying member even though the deformation due to the pressure contact of the developer quantity control blade has taken place in the developer-carrying member while the developing assembly is stopped.

Another object of the present invention is to provide a developer quantity control blade usable in the above developing assembly and free of any non-uniformity in quality, and provide its manufacturing process.

The present invention provides a developing assembly having a developer-carrying member which carries a developer from a developer container, and a developer quantity control blade which is kept in pressure contact with the developer-carrying member, wherein;

the developer-carrying member has a deformation percentage D of 0.5% or less in the direction of pressure contact, and the developer quantity control blade has a ten-point average roughness Rz of from 0.3 $\mu$m to 20 $\mu$m at its surface on the side kept in contact with the developer-carrying member (a charge control face).

The present invention also provides a developing assembly having a developer-carrying member whose surface has an Asker-C hardness of from 10° to 70°, and a developer quantity control blade having a ten-point average roughness Rz of from 0.3 $\mu$m to 20 $\mu$m at its surface on the side kept in contact with the developer-carrying member; the surface being a charge control face.

The present invention also provides a process for manufacturing a developer quantity control blade which controls the quantity of a developer transported by a developer-carrying member; the process having the steps of:

extruding a material for a blade member onto a charge control face face-transferring sheet in a uniform thickness, followed by solidification to make a blade member;

laminating the supporting member to the blade member on its side not serving as the charge control face, to bond them together to form a laminate; and cutting the laminate to have the shape of the developer quantity control blade as a final shape.

The present invention also provides a process for manufacturing a developer quantity control blade which controls the quantity of a developer transported by a developer-carrying member; the process having the steps of:

extruding a material for a blade member onto a charge control face face-transferring sheet in a uniform thickness, followed by solidification to make a blade member;

laminating the supporting member to the blade member on its side not serving as the charge control face, to bond them together to form a laminate; and cutting the laminate to have the shape of the developer quantity blade as a final shape; and in at least any one of stages before the step of lamination, after the step of lamination, before the step of cutting and after the step of cutting, the charge control face is so made rough as to have a ten-point average roughness Rz of from 0.3 $\mu$m to 20 $\mu$m.

DETAILED DESCRIPTION OF THE PREFERRED EMBODIMENTS

Conventionally, it has been considered better to make the charge control face of the developer quantity control blade smoother in order to charge and transport the developer uniformly. However, as a result of detailed studies on how the smoothness of charge control face exercises influence on the uniform charging and transport of the developer, the present inventor has discovered that it is enough for the charge control face to be smooth to a certain extent in order to achieve the uniform charging and transport of the developer. On the contrary, the present inventor has discovered that, in the case when the pressure contact of the developer quantity control blade has caused the imperceptible deformation of the developer-carrying member and the developer-carrying member does not recover from this deformation, the charge control face may rather be made rough to enable achievement of the uniform charging and transport of the developer and enable control of the faulty images such as lines and uneven images.

The reason therefore is considered to be that, even though the thin layer of the developer has become non-uniform on the developer-carrying member because of the imperceptible deformation of the developer-carrying member, any non-uniform part of the thin layer of the developer is leveled by making the charge control face rough.

As a result, even though the deformation due to the pressure contact of the developer quantity control blade has taken place in the developer-carrying member while the developing assembly is stopped, any faulty images such as lines and uneven images due to the deformation of developer-carrying member can be prevented.

The present invention is described below in detail.

Figure 1A:
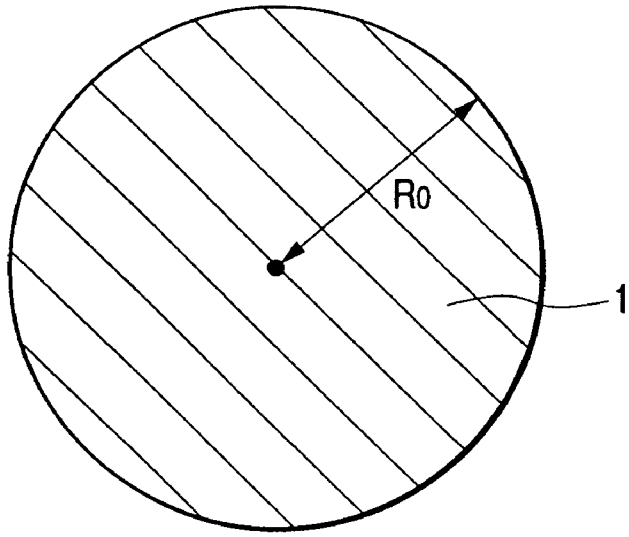
FIGS. 1A and 1B are diagrammatic sectional views to illustrate a developer-carrying roller.
Figure 1B:
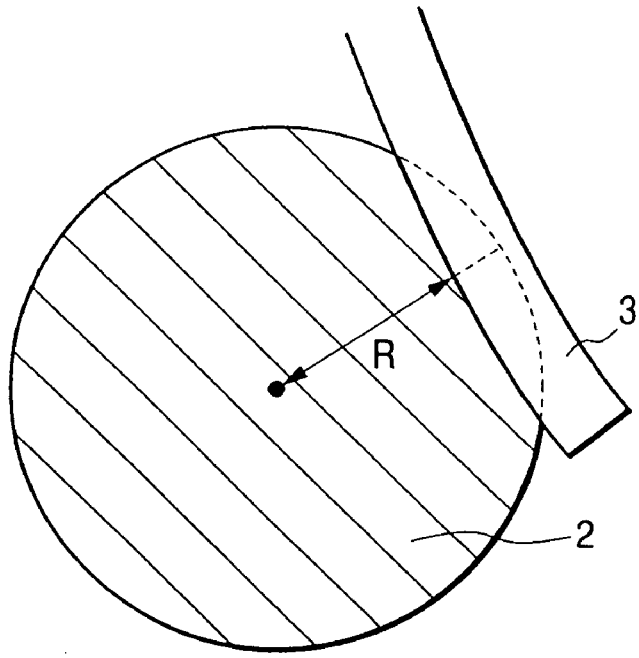

FIGS. 1A and 1B show cross sections of a developer-carrying roller in respect of a case in which the developer-carrying member has the shape of a roller. FIG. 1A is a cross-sectional view of a developer-carrying roller 1 before a developer quantity control blade is brought into pressure contact therewith, and the roller has a radius of R0. On the other hand, FIG. 1B is a cross-sectional view of a developer-carrying roller 2 when the developer quantity control blade 3 is brought into pressure contact therewith, and the developer-carrying roller stands deformed. R is the minimum length of from the centre of the developer-carrying roller to the developer quantity control blade. In the case of the one shown in FIG. 1B, its deformation percentage D is calculated as deformation percentage Dr (%) in the radius direction, according to 100×R/R0.

When the developer-carrying member stands deformed in this way, its deformation percentage D is within the range of 0.5% or less. Especially when the developer-carrying member has the shape of a roller, its deformation percentage Dr is within the range of 0.5% or less. Then, as long as the deformation percentage of the developer-carrying member is within this range, a uniform thin layer of a developer having uniformly been charged can be formed on the developer-carrying member by making the charge control face of the developer quantity control blade have a rough surface. From such a viewpoint, the charge control face may preferably have a ten-point average roughness Rz of 0.3 $\mu$m or more, more preferably 0.5 $\mu$m or more, and still more preferably 1 $\mu$m or more. On the other hand, in order to keep the chargeability of developer and the uniformity of developer thin layer from being damaged by making the charge control face too rough, it may preferably have an Rz of 20 $\mu$m or less, more preferably 15 $\mu$m or less, and still more preferably 10 $\mu$m or less.

The ten-point average roughness Rz is defined in, e.g., JIS B 0601. It may be measured with, e.g., SURFCOADER SE3500 (trade name), manufactured by Kosaka Laboratory Ltd.

The amount of deformation of the developer-carrying member when the developer quantity control blade is brought into pressure contact therewith depends greatly on the surface hardness of the developer-carrying member. As long as the developer-carrying member has sufficiently high surface hardness, the amount of deformation of the developer-carrying member can be made sufficiently small. From such a viewpoint, the surface of the developer-carrying member may preferably have an Asker-C hardness of 10° or more, more preferably 20° or more, and still more preferably 30° or more. On the other hand, for the reasons of forming a sufficient nip when the developer quantity control blade is brought into pressure contact, charging the developer sufficiently and forming a uniform thin layer, the surface of the developer-carrying member may preferably have an Asker-C hardness of 70° or less, more preferably 60° or less, and still more preferably 55° or less.

The Asker-C hardness is the hardness measured with an Asker-C type rubber hardness meter (manufactured by Kohbunshi Keiki K.K.) under a load of 5.9 N, using a test strip prepared according to a reference standard Asker-C type SRIS (Japan Rubber Association Standard) 0101.

The amount of deformation of the developer-carrying member when the developer quantity control blade is brought into pressure contact therewith depends greatly also on pressure-contact pressure of the developer quantity control blade. As long as the developer quantity control blade is at a sufficiently high pressure-contact pressure, a sufficient nip can be formed between the developer quantity control blade and the developer-carrying member, the developer can sufficiently be charged and a uniform thin layer of the developer can be formed. For such reasons, the developer quantity control blade may preferably be set at a pressure-contact pressure of 0.1 N/cm or more, more preferably 0.2 N/cm or more, and still more preferably 0.3 N/cm or more. On the other hand, for the reason of making the amount of deformation of the developer-carrying member sufficiently small, the developer quantity control blade may preferably be set at a pressure-contact pressure of 1 N/cm or less, more preferably 0.8 N/cm or less, and still more preferably 0.7 N/cm or less.

The pressure-contact pressure N/cm of the developer quantity control blade is the value found when the force N at which the developer quantity control blade is brought into pressure contact with the developer-carrying member is divided by the length (cm) of the nip in its lengthwise direction.

The charge control face of the developer quantity control blade may be made rough by, e.g., a physical method so that the surface roughness profile of the charge control face can be controlled within the stated range. As specific examples of the physical method, it may include sand blasting, shot blasting, and a method making use of sandpaper.

The charge control face of the developer quantity control blade may also be made rough by, e.g., a chemical method so that the surface roughness profile of the charge control face can be controlled within the stated range. As specific examples of the chemical method, it may include etching, and a method of forming a coating film containing coarse particles.

The charge control face of the developer quantity control blade may still also be made rough by incorporating the developer with surface-roughing fine particles so that the surface roughness profile of the charge control face can be controlled within the stated range. In this case, with use of the developing assembly for a long term, the charge control face becomes worn and can be kept from becoming flat.

As the surface-roughing fine particles, usable are fine particles of silica ($SiO_2$), alumina ($Al_2O_3$), silicon carbide (SiC), magnetite ($Fe_3O_4$), titanium oxide ($TiO_2$) and tin oxide ($SnO_2$); other inorganic fine particles; organic fine particles; and inorganic-organic hybrid fine particles. Any of these may optionally be used in combination of two or more.

As the organic fine particles, usable are fine polycarbonate particles, fine polyethylene particles, fine polypropylene particles, fine polyphenol particles, fine polysilicone particles, fine polyamide particles, fine polyacrylic particles, and fine melamine particles.

The various methods of making rough as described above may also optionally be used in combination.

In the foregoing, what has been described is how to make rough the charge control face of the developer quantity control blade. As the whole construction of the developer quantity control blade, it is preferable that at least a blade member and a support member are laminated in the same shape to make up the developer quantity control blade.

Figure 2A:
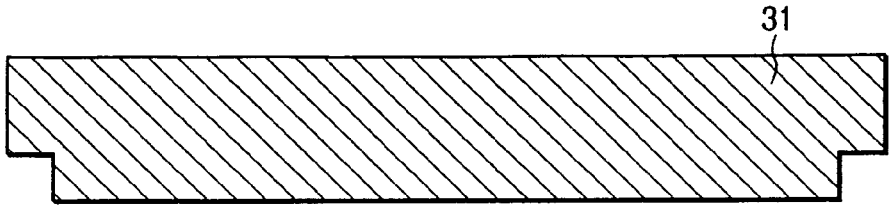
FIGS. 2A and 2B are a diagrammatic top plan view and a sectional view, respectively, to illustrate a developer quantity control blade of the present invention.
Figure 2B:
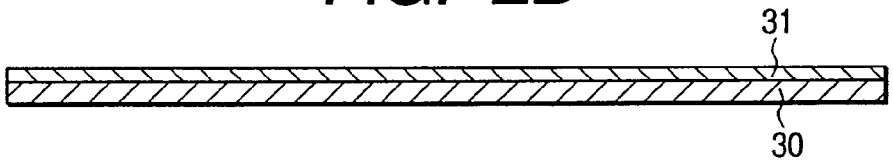

FIGS. 2A and 2B show an example of such a developer quantity control blade, as a top plan view in FIG. 2A and a cross-sectional view in FIG. 2B. A blade member 30 and a support member 31 are laminated and bonded together over the whole area of the developer quantity control blade. Thus, the blade member 30 and the support member 31 each have the same planar shape as the planar shape of the developer quantity control blade.

Figure 3:
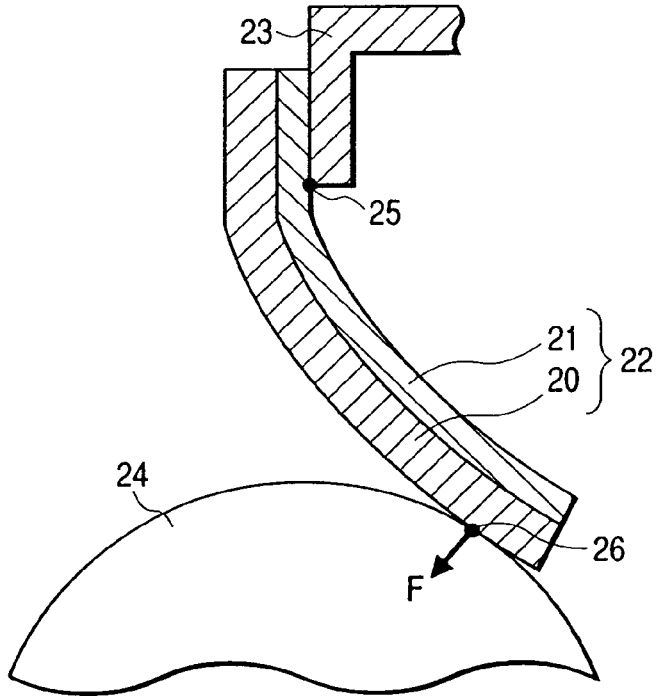
FIG. 3 is a diagrammatic sectional view to illustrate a developer quantity control blade of the present invention.

FIG. 3 shows how a developer quantity control blade 22 produced by laminating a blade member 20 and a support member 21 is fastened to a developer container 23 at a fastening point 25 and is kept in pressure contact with a developer-carrying member 24 at a pressure contact point 26 to exert pressure contact force F.

Here, the upper and lower end portions of a laminate of the blade member to the support member come present on both end portions of the developer quantity control blade. Hence, the fulcrum (supporting point) of the moment in respect to the force necessary for the action of rubbing friction of the developer quantity control blade with the developer-carrying member does not come in the middle of the developer quantity control blade. As a result, the force that may otherwise make the developer quantity control blade bend in the middle thereof because of a difference in materials between the blade member and its support member can be kept from concentrating, so that the developer quantity control blade bends substantially uniformly as a whole. As the result, the blade member can be kept from wearing non-uniformly.

The blade member is also laminated to the support member over its whole area, and hence the developer quantity control blade 22 bends gently as a whole. In other words, the blade member 20 is present up to the end portion (the fastening point 25 side) opposite to the rubbing-friction end portion, and hence it follows that the moment produced correspondingly to the pressure contact force acts on the part of rubbing friction through a long arm, so that the pressure contact force acts gently and efficiently on developer particles.

Thus, the uniform wear of the blade member can be achieved. Also, the pressure contact force can be controlled with a good precision to achieve a proper force of pressure to the developer particles.

As described above, where the developer quantity control blade is of whole-area laminated structure, the developer quantity control blade, when the pressure contact force is applied thereto, comes into pressure contact with the developer-carrying member and then, bending further, presses against the developer-carrying member. Here, some impact resilience ascribable to the developer quantity control blade acts, but the total sum of the resilience of the blade member and support member is considered to contribute to the pressure contact force.

There are developer (toner) particles between the blade member and the developer-carrying member. Where the blade member has a too small thickness, the blade member, which is richer in variability, has a possibility of being forced back. On the other hand, where the blade member has a too large thickness, there is a possibility that any repulsion attributable to the toner particles is so insufficient that any sufficient charging cannot be performed.

In addition to the thickness of the blade member, the behavior of pressure contact of toner is also influenced by the elasticity of the blade member, the thickness of the support member and the rigidity of the support member. Similarly, the total thickness of the developer quantity control blade is also an important factor.

From the foregoing viewpoints, in order to achieve a sufficient function as the blade, the blade member may preferably have a thickness of 1 $\mu$m or more, and more preferably 10 $\mu$m or more. It may also have a thickness of 50 $\mu$m or more, or may have even a thickness of 100 $\mu$m or more. On the other hand, in order to achieve appropriate pressure contact, charge the developer particles uniformly and keep the blade member from wearing, the blade member may preferably have a thickness of 300 $\mu$m or less, more preferably 100 $\mu$m or less, and still more preferably 50 $\mu$m or less.

Also from the like viewpoints, the support member may preferably have a thickness of 50 $\mu$m or more, more preferably 80 $\mu$m or more, still more preferably 90 $\mu$m or more, and most preferably 100 $\mu$m or more. On the other hand, it may preferably have a thickness of 150 $\mu$m or less.

Further from the like viewpoints, the total thickness of the developer quantity control blade may preferably be the sum of the blade member thickness described above and the support member thickness described above, e.g., preferably from 51 $\mu$m to 450 $\mu$m.

In addition, still further from the like viewpoints, the blade member may preferably be made from urethane rubber, polyamide resin, polyamide elastomer, silicone rubber, silicone resin or the like, and the support member may preferably be made of a metal flat sheet or a resin flat sheet, and stated more specifically a stainless-steel sheet, a phosphor bronze sheet, an aluminum sheet or the like. Also, in order to achieve any desired charging performance and so forth, an additive such as a conductive material may be added to the above chief materials for the blade member. Still also, the support member and the blade member may be joined by, e.g. bonding with an adhesive such as a hot-melt adhesive.

As a process for manufacturing the developer quantity control blade described above, the blade can be manufactured with good precision and good productivity by extruding the material for the blade member onto a sheet which is a charge control face face-transferring sheet and whose surface has a ten-point average roughness Rz of from 0.3 $\mu$m to 20 $\mu$m, in a uniform thickness, followed by solidification to make a blade member; laminating the supporting member to the blade member on its side not serving as the charge control face, to bond them together to form a laminate; and cutting the laminate to have the shape of the developer quantity control blade as a final shape, by means of a press and a cutter.

The developer quantity control blade can also be manufactured with good precision and good productivity by a process comprising extruding the material for the blade member onto a charge control face face-transferring sheet with a uniform thickness, followed by solidification to make a blade member; laminating the supporting member to the blade member on its side not serving as the charge control face, to bond them together to form a laminate; and cutting the laminate to have the shape of the developer quantity control blade as a final shape, by means of a press and a cutter; wherein, in at least any one of stages before the step of lamination, after the step of lamination, before the step of cutting and after the step of cutting, the charge control face is so made rough as to have a ten-point average roughness Rz of from 0.3 $\mu$m to 20 $\mu$m.

Figure 4A:
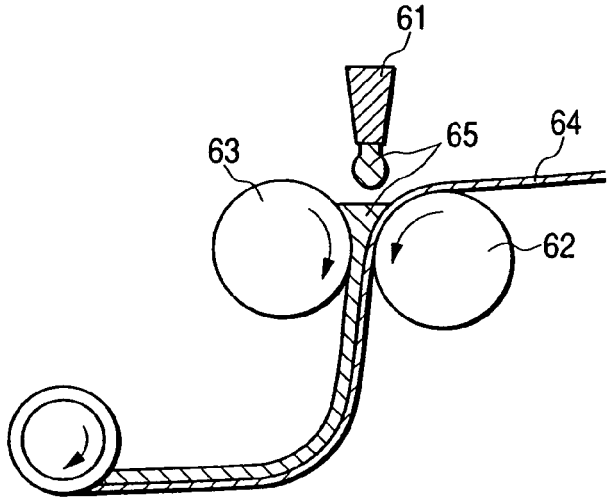
FIGS. 4A and 4B are diagrammatic sectional views to illustrate a developer quantity control blade manufacturing process of the present invention.

An example of a blade member manufacturing process which utilizes roll coating is shown in FIG. 4A. First, a face-transferring sheet 64 is set on a roll 62. A material 65 for the blade member is injected and fed from a nozzle 61, and is passed through a gap between rolls 62 and 63 which has been adjusted to a preset space. Thereafter, the material 65 is solidified by drying. Thus, a blade member is obtained which has been covered with the face-transferring sheet on the former's charge control face side.

Here, the surface of the roll 63 positioned on the side of the material 65 for the blade member may preferably be a rough surface, aside from the charge control face.

More specifically, the surface of the roll on the side opposite to the face-transferring sheet and coming into contact with the material for the blade member is made to be a rough surface. In this case, of the both sides of the blade member obtained, the side to which the support member is to be bonded is made to be a rough surface. As the result, the blade member can have a larger contact surface area on that side, and also, because of an anchor effect, a great adhesive force can be obtained between the blade member and the support member. From such a viewpoint, the rough surface may preferably have a ten-point average roughness Rz of 1.5 $\mu$m or more.

The rough surface of that roll may be formed by embossing with a pattern of various types, or by scratch patterning. Such a surface may be obtained by etching or mechanical surface-roughing. Also, it is preferable to avoid any surface-roughing that may affect the surface properties of the blade member on the side of the face-transferring sheet (charge control face), and the rough surface may preferably have a ten-point average roughness Rz of 5.0 μm or less.

Such a rough-surface roll need not necessarily be metallic, and any heat-resistant material may suffice. For example, it is effective to use a silicone rubber roll subjected to surface-roughing treatment. A ceramic material may also be used, which may be provided with a reinforcing coating on its surface if there is concern about brittleness.

Incidentally, after the blade member and the support member have been bonded together, these may be heated to achieve much higher adherence.

As the face-transferring sheet, a film formed of a polyester resin, a polyamide resin, a polyolefin resin, a copolymer of any of these or an alloy of any of these may be used. In particular, a film formed of at least one selected from polyethylene terephthalate, polyethylene-2,6-naphthalate and a copolymer or composite of these is preferred.

Next, to the blade member thus obtained, after an adhesive coating has been formed on its surface opposite to the side covered with the face-transferring sheet, the support member is bonded to make up a laminated structure. Then, the laminate thus obtained is cut into a stated shape by, e.g., press cutting.

Figure 4B:
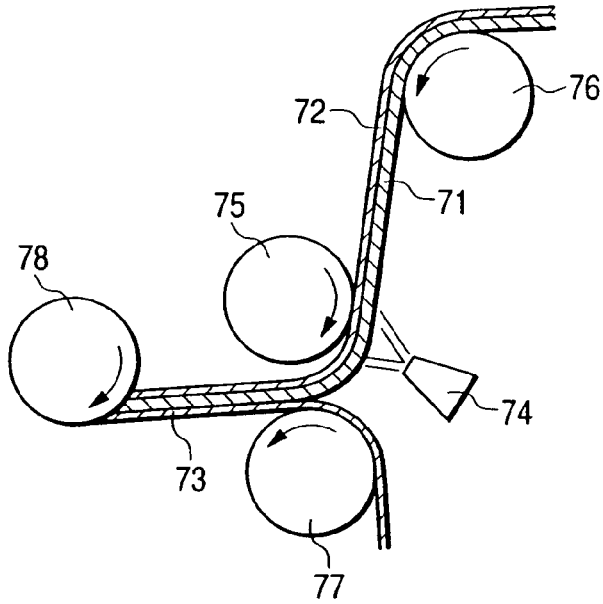

The blade member and the support member may also continuously be bonded together by means of an apparatus as shown in FIG. 4B. More specifically, a multi-layer sheet consisting of a blade member 71 and a face-transferring sheet 72 is fed to a roll 75 via a roll 76, and an adhesive is coated by a spray coater 74 on the blade member 71 on its side to which the support member is to be bonded. Thereafter, feeding a support member 73 through a roll 77, the support member 73 is bonded to the blade member 71, and the laminate thus obtained is wound up on a roll 78.

In the manufacturing process described above, as being different from blade members formed in a mold, the material for the blade member is accumulated on the face-transferring sheet, and the face-transferring sheet face is replicated to the blade member.

As another process for manufacturing the developer quantity control blade, the blade can be manufactured with good precision and good productivity by co-extruding a molten resin for forming a face-transferring sheet for charge control face and a molten resin for forming a blade member, followed by shaping into a cylinder by multi-layer blown-film extrusion; cutting the resultant cylinder in parallel to the direction of extrusion to form at least one multi-layer sheet; laminating the supporting member to the multi-layer sheet on its side with the blade member, to bond them together to form a laminate; and cutting the laminate to have the shape of the developer quantity control blade as a final shape.

The face-transferring sheet is peeled before the developer quantity control blade is used, and hence it is preferable for the face-transferring sheet and the blade member to have good releasability. From such a viewpoint, the resin for the face-transferring sheet may preferably be a straight-chain high polymer not containing any polar group, and the resin for the blade member a high polymer containing a polar group.

As the straight-chain high polymer not containing any polar group, an olefinic high polymer is preferred.

As the high polymer containing a polar group, a polyamide high polymer is preferred.

The face-transferring sheet of the developer quantity control blade thus manufactured may preferably not be peeled just until the developer quantity control blade is attached to the preset position of the developing assembly, in order that the developer quantity control blade covered with the face-transferring sheet can be stored and transported as a part (a stock). Here, the face-transferring sheet does a part as a protective sheet of the developer quantity control blade.

Figure 5:
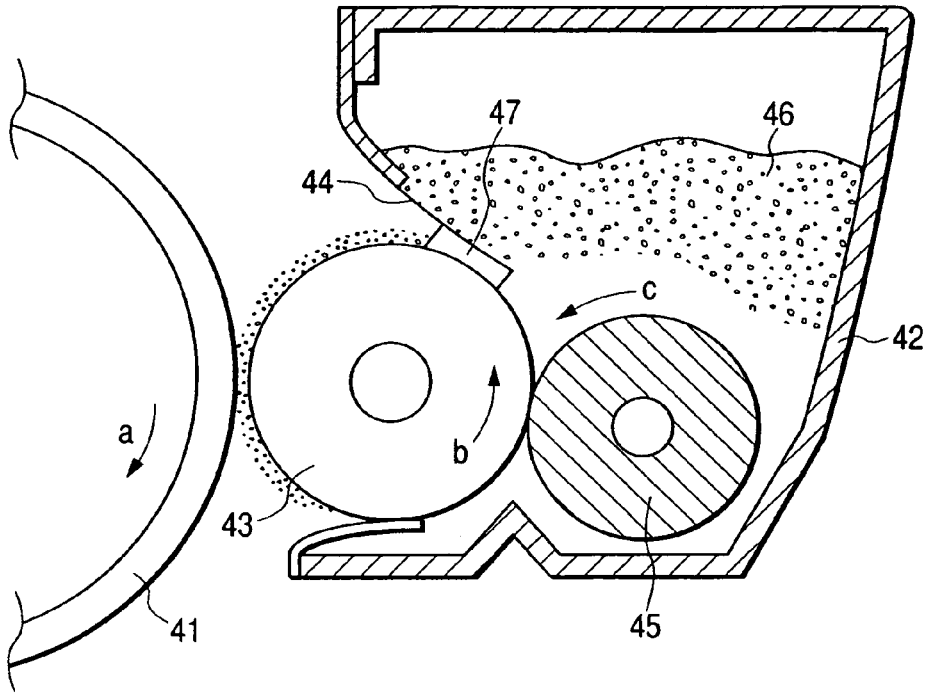
FIG. 5 is a diagrammatic sectional view to illustrate a developing assembly.

An example of a developing assembly making use of the developer quantity control blade of the present invention is shown in FIG. 5. Reference numeral 42 denotes a developer container holding therein, e.g., a one-component developer 46. This developing assembly has, inside the developer container 42, a developing sleeve serving as a developer-carrying member 43 which is provided opposingly to an image-bearing member electrophotographic photosensitive member 41 rotatable in the direction of an arrow a shown in the drawing and develops an electrostatic latent image on the electrophotographic photosensitive member 41 to render it visible as a toner image. The developer-carrying member 43 is rotatably laterally provided opposingly to the electrophotographic photosensitive member 41 in such a manner that it is thrust into the developer container 42 by substantially the right half of its periphery as viewed in the drawing, and is exposed to the outside of the developer container 42 by substantially the left half of its periphery. A minute gap is provided between the developer-carrying member 43 and the electrophotographic photosensitive member 41. The developer-carrying member 43 is rotated in the direction of arrow b against the rotational direction a of the electrophotographic photosensitive member 41.

Inside the developer container 42, a developer quantity control blade 44 of the present invention is provided at the upper position of the developer-carrying member (developing sleeve) 43. An elastic roller 45 is also provided at the position on the side upstream to a blade member 47, of the rotational direction of the developing sleeve 43.

The developer quantity control blade 44 is provided obliquely in the downward direction toward the upstream side of the rotational direction of the developing sleeve 43, and is brought into contact with the upper periphery of the developing sleeve 43 against its rotational direction.

The elastic roller 45 is provided in contact with the developing sleeve 43 at its part opposite to the electrophotographic photosensitive member 41, and is rotatably supported.

In the developing assembly constructed as described above, the elastic roller 45 is rotated in the direction of an arrow c to carry a toner 46 and feed it to the vicinity of the developing sleeve 43 as the elastic roller 45 is rotated. The toner 46 carried on the elastic roller 45 is caused to rub against the surface of the developing sleeve 43 at a contact zone (nip) where the developing sleeve 43 and the elastic roller 45 come into contact, so that the toner adheres to the surface of the developing sleeve 43.

Thereafter, with the rotation of the developing sleeve 43, the toner 46 having adhered to the surface of the developing sleeve 43 reaches the contact zone between the developer quantity control blade 44 and the developing sleeve 43 to be held between them, and is rubbed with both the surface of the developing sleeve 43 and the blade member 47 when passed there, so that the toner is sufficiently triboelectrically charged.

The toner 46 thus charged gets away from the contact zone between the blade member 47 and the developing sleeve 43, so that a thin layer of the toner is formed on the developing sleeve 43, and is transported to the developing zone where the sleeve 43 faces the electrophotographic photosensitive member 41 leaving a minute gap. Then, at the developing zone and across the developing sleeve 43 and the electrophotographic photosensitive member 41, for example an alternating voltage formed by superimposing an alternating current on a direct current is applied as a development bias, whereupon the toner 46 carried on the developing sleeve 43 is transferred to the electrophotographic photosensitive member 41 correspondingly to the electrostatic latent image to adhere to the electrostatic latent image to develop it, so that it is rendered visible as a toner image.

The toner 46 not consumed in the development at the developing zone and having remained on the developing sleeve 43 is collected into the developer container 42 at the lower part of the developing sleeve 43 as the developing sleeve 43 is rotated.

The toner 46 collected is scraped off by the elastic roller 45 from the surface of the developing sleeve 43 at the contact zone between the elastic roller 45 and the developing sleeve 43. At the same time, as the elastic roller 45 is rotated, the toner 46 is anew fed onto the developing sleeve 43, and the new toner 46 is again transported to the contact zone between the developing sleeve 43 and the blade member 47.

Meanwhile, the greater part of the toner 46 scraped off is, as the elastic roller 45 is rotated, mutually mixed with the toner 46 remaining in the developer container 42, where the triboelectric charges of the toner scraped off are dispersed.

Figure 6:
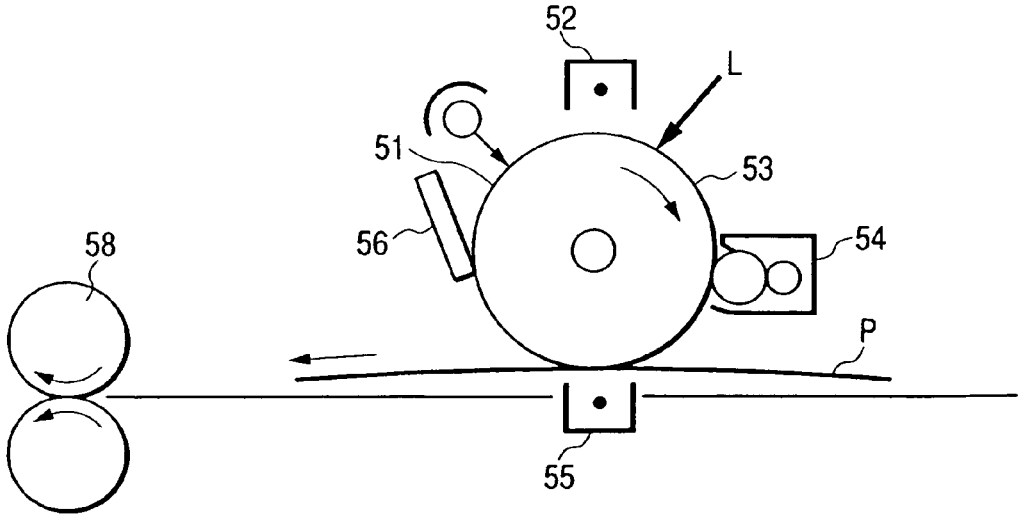
FIG. 6 is a diagrammatic sectional view to illustrate an electrophotographic apparatus.

An example of an electrophotographic apparatus suited for employing the developing assembly of the present invention is shown in FIG. 6. Reference numeral 51 denotes a photosensitive member serving as the image-bearing member. What is used in this example is a drum type electrophotographic photosensitive member constituted basically of a conductive support made of aluminum or the like and a photosensitive layer formed on its periphery. It is rotatingly driven around an axis in the clockwise direction as viewed in the drawing, and at a stated peripheral speed.

A charging means 52 is a corona charging assembly (discharger) which is in contact with the surface of the photosensitive member 51 and primarily uniformly charges the photosensitive member surface to stated polarity and potential. This may also be a charging roller.

The photosensitive member 51 surface thus charged uniformly by the charging member 52 is then exposed to light of intended image information by an exposure means L (laser beam scanning exposure or original-image slit exposure), whereupon electrostatic latent images 53 corresponding to the intended image information are formed on the periphery of the photosensitive member.

The electrostatic latent images thus formed are subsequently developed as toner images by means of a developing assembly 54.

The toner images thus formed are then successively transferred by the operation of a transfer means 55, to the surface of a transfer material P fed from a paper feed section to a transfer zone between the photosensitive member 51 and the transfer means 55 in the manner synchronized with the rotation of the photosensitive member 51 and at proper time.

The transfer means 55 in this example is a corona discharger (may be of a roller type), which charges the transfer material P on its back to a polarity reverse to that of the toner, whereupon the toner images on the side of the photosensitive member 51 surface are transferred on to the surface of the transfer material P. In a color LBP (laser beam printer) which reproduces color images using four color toners, in order to develop four color latent images individually to render them visible, toner images are first transferred to an intermediate transfer member such as a roller or a belt, and then the toner images are transferred on to the surface of the transfer material P.

The transfer material P to which the toner images have been transferred is separated from the surface of the photosensitive member 51, forwarded to heat fixing rolls 58, where the toner images are fixed, and then put out of the apparatus as an image-formed material.

The surface of the photosensitive member 51 from which toner images have been transferred is brought to removal of adherent contaminants such as transfer residual toners, through a cleaning means 56. Thus the photosensitive member is cleaned on its surface, and then repeatedly used for the formation of images.

Incidentally, a plurality of components of the electrophotographic apparatus, such as the photosensitive member, the charging member, the developing assembly and the cleaning means, may integrally be incorporated in a process cartridge so that the process cartridge is detachably mountable to the body of the electrophotographic apparatus. For example, the photosensitive member and the developing assembly, optionally together with the charging means and the cleaning means, may integrally be incorporated in a process cartridge so as to be detachably mountable through a guide means such as rails provided in the body of the apparatus.

The electrophotographic apparatus in which the developing assembly of the present invention is usable may include copying machines, laser beam printers, LED printers, and apparatus where electrophotography is applied, such as electrophotographic plate making systems.

EXAMPLES

The present invention is described below in greater detail by giving Examples and Comparative Example. The present invention is by no means limited to the following Examples.

In the following, unless otherwise stated, commercially available high-purity products are used as reagents and so forth.

EXAMPLES 1, 2, 3, 4, 5 AND 6

Polyethylene terephthalate films as produced by extrusion and of 0.1 mm in thickness were subjected to surface treatment by means of the sand blasting to prepare face-transferring sheets having a surface roughness Rz of 0.5 $\mu$m, 1.0 $\mu$m, 5 $\mu$m, 10 $\mu$m, 15 $\mu$m, and 20 $\mu$m. Then, as a material for the blade member, a polyamide elastomer (trade name: DAIAMID PAE E40-S3; available from Daicel-Huels Ltd.) was melted to 250° C. The molten product obtained was so extruded onto each of the face-transferring sheets that its thickness came to 0.05 mm, 0.1 mm or 0.2 mm after solidifying, and sheetlike laminates of 0.15 mm, 0.2 mm or 0.3 mm in total thickness were produced by roll coating.

To each of these sheetlike laminates, a phosphor bronze sheet of 0.12 mm or 0.15 mm in sheet thickness was bonded providing between them an adhesive layer comprised of ADCOAT AD-76P1 (trade name), available from Toyo Moton K.K., to bond them together.

Thereafter, the resulting sheetlike laminates were press-cut in a prescribed blade size. Thus, developer quantity control blades 1 to 6 were manufactured. Here, the developer quantity control blades were 200 mm in length and 23 mm in width.

Meanwhile, as a developer-carrying roller, a roller comprised of silicone rubber and on the periphery of which a skin layer of urethane rubber was formed was prepared. Its surface had an Asker-C hardness of 52°.

This developer-carrying roller and each of the developer quantity control blades 1 to 6 were so set together as to be under a pressure-contact pressure of 0.5 N/cm to make up developing assemblies 1 to 6. Here, the developer-carrying roller had a deformation percentage Dr of 0.4% in the radius direction.

The face-transferring sheet was peeled immediately before the developer quantity control blades were used, and the surface roughness Rz of each of the charge control faces was measured by means of SURFCOAT SE3500 (trade name), manufactured by Kosaka Laboratory Ltd. to find that it was 0.5 μm, 1.0 μm, 5 μm, 10 μm, 15 μm and 20 μm.

Comparative Example 1

A developing assembly 7 was manufactured in the same manner as in the case of the developing assembly 1 except that a polyethylene terephthalate film having a surface roughness (ten-point average roughness) Rz of 0.2 μm was used as the face-transferring sheet.

The solid black density was measured at five spots including four corners of the A4 size paper and its center portion and the values thus obtained were averaged for evaluation.

Solid black density unevenness was evaluated making use of a difference (R) between the maximum value and the minimum value among values of the five spots, in accordance with the following criteria:

AA: R is less than 0.3;

A: R is less than 0.6 to 0.3 or more;

B: R is less than 1.0 to 0.6 or more; and

C: R is 1.0 or more.

Image lines and image unevenness were evaluated by using as a reference the image which was obtained by means of the developing assembly 7 (Comparative Example 1), according to four ranks of "very superior"(AAA), "superior" (AA), "substantially equal" (A), and "inferior to the reference" (B).

The results are shown in Table 1.

TABLE 1

Results of Evaluation

| | Example 1 | Example 2 | Example 3 | Example 4 | Example 5 | Example 6 | Comparative Example 1 | Comparative Example 2 |
|---|---|---|---|---|---|---|---|---|
| Blade member thickness | 0.05 | 0.05 | 0.05 | 0.05 | 0.05 | 0.05 | 0.05 | 0.05 |
| Support member thickness | 0.12 | 0.12 | 0.12 | 0.12 | 0.12 | 0.12 | 0.12 | 0.12 |
| Surface roughness Rz (μm) | 0.5 | 1.0 | 5.0 | 10.0 | 15.0 | 20 | 0.2 | 5.0 |
| Deformation percentage (Dr) | 0.4 | 0.4 | 0.4 | 0.4 | 0.4 | 0.4 | 0.4 | 5.0 |
| Solid black density (average value) | 1.46 | 1.46 | 1.47 | 1.45 | 1.43 | 1.41 | 1.47 | 1.45 |
| Solid black density unevenness | A | AA | AA | AA | A | A | A | C |
| Line evaluation | AA | AAA | AAA | AAA | AA | AA | A | B |
| Unevenness evaluation | AA | AAA | AAA | AAA | AA | AA | A | B |

Comparative Example 2

A developing assembly 8 was manufactured in the same manner as in the case of the developing assembly 3 except that the developer-carrying roller was made to have a deformation percentage Dr of 5% in the radius direction.

Performance Evaluation:

The developing assemblies 1 to 8 thus manufactured were each fitted to a color laser beam printer (trade name: LASER SHOT; manufactured by CANON INC.) in a low-temperature and low-humidity environment (LL) of 15° C. and 10 RH % to conduct print tests.

The print tests were conducted in such a way that a black solid image on the paper face was reproduced as a copied product by the use of a non-magnetic black toner and the image forming performance was measured as a solid black density by means of a Macbeth densitometer for evaluation.

As can be seen from Table 1, the use of developing assemblies manufactured in Examples 1, 2, 3, 4, 5 and 6 enables formation of high-grade images. Table 1 shows evaluation results of the tests in the LL environment, 10 and also when the tests were carried out in environments of 23° C. and 50 RH % (NN environment) and of 32.5° C. and 80 RH % (HH environment), substantially the same results were obtained.

Also, the tests as described above were performed in respect of the blade member thickness of 0.1 mm and 0.2 mm and the support member thickness of 0.15 mm, so that substantially the same results were obtained.

What is claimed is:

1. A developing assembly comprising:

a developer-carrying member which carries a developer from a developer container; and a developer quantity control blade which is kept in pressure contact with the developer-carrying member, wherein said developer-carrying member has a deformation percentage D of 0.5% or less in a direction of pressure contact, wherein said developer quantity control blade has a ten-point average roughness Rz in a range of 0.3 $\mu$m to 20 $\mu$m at a surface thereof on a side kept in contact with said developer-carrying member, and wherein said surface is a charge control face, and wherein said developer-carrying member has a surface having an Asker-C hardness in a range of 10° to 70°.

2. The developing assembly according to claim 1, wherein said developer-carrying member has a shape of a roller, and wherein the deformation percentage is a deformation percentage Dr in a radial direction.

3. The developing assembly according to any one of claims 1 to 2, wherein said developer quantity control blade is set at a pressure-contact pressure in a range of 0.1 N/cm to 1 N/cm against said developer-carrying member.

4. The developing assembly according to claim 1, wherein said charge control face is made rough by at least any one of a physical method and a chemical method.

5. The developing assembly according to claim 1, wherein said developer contains surface-roughing fine particles.

6. The developing assembly according to claim 5, wherein said surface-roughing fine particles comprises fine particles selected from the group consisting of fine particles of silica $SiO_2$, alumina $Al_2O_3$, silicon carbide SiC, magnetite $Fe_3O_4$, titanium oxide $TiO_2$ and tin oxide $SnO_2$, other inorganic fine particles, organic fine particles, and inorganic-organic hybrid fine particles.

* * * * *